US008984908B2

(12) United States Patent
Bae et al.

(10) Patent No.: US 8,984,908 B2
(45) Date of Patent: Mar. 24, 2015

(54) REFRIGERATOR

(75) Inventors: Jun Ho Bae, Seoul (KR); Chung Joon Kim, Seoul (KR); Soo Kwan Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1070 days.

(21) Appl. No.: 12/530,653

(22) PCT Filed: Mar. 28, 2008

(86) PCT No.: PCT/KR2008/001740

§ 371 (c)(1),
(2), (4) Date: Sep. 10, 2009

(87) PCT Pub. No.: WO2008/120906

PCT Pub. Date: Oct. 9, 2008

(65) Prior Publication Data

US 2010/0107677 A1 May 6, 2010

(30) Foreign Application Priority Data

Mar. 31, 2007 (KR) ..... 10-2007-0032112

(51) Int. Cl.
*F25D 17/06* (2006.01)

(52) U.S. Cl.
CPC ..... *F25D 17/065* (2013.01); *F25D 2317/061* (2013.01)
USPC ..... 62/419; 62/441

(58) Field of Classification Search
CPC ..... F24D 17/065; F24D 2317/061
USPC ..... 62/407, 408, 418, 419, 409, 156
See application file for complete search history.

(56) References Cited

U.S. PATENT DOCUMENTS 3,067,588 A * 12/1962 Whitmore ..... 62/268
3,169,383 A * 2/1965 Morton et al. ..... 62/414
3,364,696 A * 1/1968 Maxwell ..... 62/414

(Continued)

FOREIGN PATENT DOCUMENTS

CN 1421666 A 6/2003
CN 1464260 12/2003

(Continued)

OTHER PUBLICATIONS

International Search Report dated Mar. 23, 2009.
Korean Decision to Grant a Patent dated Jan. 28, 2009.
Chinese Office Action dated Jul. 12, 2010 issued in Application No. 200880010571.6.

*Primary Examiner* — Mohammad M Ali
(74) *Attorney, Agent, or Firm* — KED & Associates, LLP

(57) ABSTRACT

A refrigerator that is capable of easily operating a storage chamber (30) where cooling is carried out independently from a cold chamber (10) is disclosed. The refrigerator includes a refrigerator body having a cold chamber (10) defined therein and a storage chamber (30) disposed in the cold chamber, a cool air generation chamber having a cooler and a fan (102) for supplying cool air mounted therein, a partition plate for partitioning the cold chamber (10) and the cool air generation chamber from each other, the partition plate having a main flow channel (103) for guiding the cool air supplied by the fan (102) to the cold chamber (10) and at least one cool air hole (201) located between the fan (102) and the main flow channel (103) for bypassing the cool air, and at least one bypass duct (200) for guiding the cool air bypassed through the at least one cool air hole (201) to the storage chamber (30).

15 Claims, 6 Drawing Sheets

(56) References Cited

U.S. PATENT DOCUMENTS

| | | | | | |
|---|---|---|---|---|---|
| 4,768,353 | A | * | 9/1988 | Bushser | 62/408 |
| 5,392,615 | A | * | 2/1995 | Lim | 62/414 |
| 5,775,124 | A | * | 7/1998 | Park et al. | 62/408 |
| 6,497,113 | B1 | * | 12/2002 | Yamada et al. | 62/441 |
| 6,655,169 | B2 | * | 12/2003 | Tupis et al. | 62/417 |
| 6,725,678 | B2 | * | 4/2004 | Chang et al. | 62/156 |
| 2004/0107724 | A1 | * | 6/2004 | Kim et al. | 62/408 |
| 2006/0070395 | A1 | * | 4/2006 | Lee et al. | 62/408 |
| 2007/0163291 | A1 | * | 7/2007 | Kim et al. | 62/408 |

FOREIGN PATENT DOCUMENTS

| | | | | |
|---|---|---|---|---|
| EP | 1 314 940 | | | 5/2003 |
| JP | 06117744 | A | * | 4/1994 |
| KR | 10-0377254 | | | 6/1996 |
| KR | 10-2003-0024003 | | | 3/2003 |
| KR | 10-2003-0039024 | A | | 5/2003 |
| KR | 10-2003-0041592 | A | | 5/2003 |
| KR | 10-2003-0043223 | A | | 6/2003 |
| KR | 10-2004-0049610 | A | | 6/2004 |
| KR | 10-2007-0016319 | A | | 2/2007 |

* cited by examiner

REFRIGERATOR

TECHNICAL FIELD

The present invention relates to a refrigerator, and more particularly, to a refrigerator that is capable of easily operating a storage chamber where cooling is carried out independently from a cold chamber, thereby achieving effective operation of the refrigerator.

BACKGROUND ART

Generally, a refrigerator is an appliance that is capable of preserving foods at low temperature for a long time through the supply of cool air, generated by a refrigeration cycle apparatus including a compressor and a heat exchanger, to a cold chamber, such as a refrigerator compartment or a freezer compartment, defined therein.

For the refrigerator, an additional storage chamber is disposed in the cold chamber. The storage chamber is controlled independently from the cold chamber such that the storage chamber is given the optimum cooling conditions in which cooling is possible at various temperature zones according to the properties of objects to be cooled, and, at the same time, the properties of the objects are maintained as long as possible.

Technologies for independently controlling the supply of cool air to the storage chamber through the use of an additional evaporator to independently operate the storage chamber have been proposed.

DISCLOSURE OF INVENTION

Technical Problem

However, the provision of the evaporator and the independent control of the evaporator increase the manufacturing costs of the refrigerator. Furthermore, such complicated controlling process may lead to the malfunction of the refrigerator.

A cooler for operation of the cold chamber may be used to independently control the storage chamber in place of the evaporator. In this case, however, a plurality of complicated apparatuses are required, and therefore, the structure and control of the refrigerator are still complicated.

Technical Solution

Accordingly, the present invention is directed to a refrigerator that substantially obviates one or more problems due to limitations and disadvantages of the related art.

Advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a refrigerator body having a cold chamber defined therein and a storage chamber, of a predetermined cooling space, disposed in the cold chamber, a cool air generation chamber having a cooler and a fan for supplying cool air mounted therein, a partition plate for partitioning the cold chamber and the cool air generation chamber from each other, the partition plate having a main flow channel for guiding the cool air supplied by the fan to the cold chamber and at least one cool air hole located between the fan and the main flow channel for bypassing the cool air, and at least one bypass duct for guiding the cool air bypassed through the at least one cool air hole to the storage chamber.

Preferably, the refrigerator further includes a damper disposed between the main flow channel and the at least one cool air hole for selectively introducing the cool air supplied by the fan to the main flow channel.

Preferably, the at least one cool air hole is formed in the shape of a slot lengthened in the direction perpendicular to the direction in which the cool air flows from the fan to the main flow channel.

Preferably, the at least one bypass duct extends from the at least one cool air hole toward the storage chamber, the at least one bypass duct being disposed at the front of the partition plate.

Preferably, the at least one bypass duct extends from the at least one cool air hole to the storage chamber along the side of the cold chamber.

In another aspect of the present invention, a refrigerator includes a refrigerator body having a cold chamber defined therein and a storage chamber, of a predetermined cooling space, disposed in the cold chamber, a cool air generation chamber having a cooler and a fan for supplying cool air mounted therein, a partition plate for partitioning the cold chamber and the cool air generation chamber from each other, the partition plate having a main flow channel provided with a plurality of discharge ports for guiding the cool air supplied by the fan to the cold chamber, and at least one bypass duct for guiding the cool air discharged through at least one of the discharge ports to the storage chamber.

Preferably, the at least one bypass duct extends from the discharge ports to the storage chamber along the side of the cold chamber.

In another aspect of the present invention, a refrigerator includes a refrigerator body, a cold chamber defined in the refrigerator body, a storage chamber disposed in the cold chamber, a main flow channel communicating with the cold chamber for guiding cool air to the cold chamber, and a bypass duct disposed separately from the main flow channel for guiding cool air in the direction in which the cool air flows to the storage chamber and in the direction different from the flow direction of the cool air guided by the main flow channel.

Preferably, the refrigerator further includes a cooler for generating cool air, a fan for blowing the cool air generated by the cooler, and a cool air generation chamber communicating the bypass duct and the main flow channel, the cooler and the fan being mounted in the cool air generation chamber.

Preferably, the refrigerator further includes a damper mounted in the cool air generation chamber such that the damper is disposed between the bypass duct and the main flow channel for selectively opening and closing the bypass duct and the main flow channel.

Preferably, the bypass duct is disposed such that the bypass duct is directed to the lower part of the cold chamber.

Preferably, in the bypass duct is disposed at the rear of the storage chamber.

Preferably, the bypass duct is disposed along the side of the cold chamber.

Preferably, the bypass duct is disposed such that the bypass duct communicates with the main flow channel, and therefore, some of the cool air flowing along the main flow channel flows to the bypass duct.

Preferably, the refrigerator further includes a communication port formed at the storage chamber for guiding the introduction of the cool air in the cold chamber to the storage chamber.

Preferably, the refrigerator further includes a guide hole formed at the bypass duct at a position corresponding to the communication port of the storage chamber for guiding the cool air to the communication port.

Preferably, the refrigerator further includes a connection channel directly interconnecting the bypass duct and the storage chamber for guiding the cool air.

In a further aspect of the present invention, a refrigerator includes a refrigerator body having a cold chamber defined therein and a storage chamber, of a predetermined cooling space, disposed in the cold chamber, a cool air generation chamber having a cooler and a fan for supplying cool air mounted therein, a partition plate for partitioning the cold chamber and the cool air generation chamber from each other, the partition plate having a main flow channel for guiding the cool air supplied by the fan to the cold chamber, and at least one bypass duct including a first duct part disposed in the cool air generation chamber for bypassing the cool air and a second duct part extending from the first duct part and connected to the storage chamber.

Preferably, the first duct part is disposed in the cool air generation chamber such that the first duct part is directed downward, and the second duct part extending from the lower end of the first duct part such that second duct part 220 is directed toward the storage chamber in the front direction.

Preferably, the first duct part is disposed between the partition plate and the cooler.

It is to be understood that both the foregoing general description and the following detailed description of the present invention are exemplary and explanatory and are intended to provide further explanation of the invention as claimed.

Advantageous Effects

As apparent from the above description, the refrigerator according to the present invention has the effect of independently operating the cold chamber and the storage chambers without the provision of an additional evaporator, and, even in this case, uniformly maintaining the interior temperature of the storage chambers without difficulty, and uniformly distributing the temperature throughout the cold chamber.

MODE FOR THE INVENTION

Reference will now be made in detail to the preferred embodiments of the present invention, examples of which are illustrated in the accompanying drawings. Wherever possible, the same reference numbers will be used throughout the drawings to refer to the same or like parts.

First, the structure of a refrigerator according to a first embodiment of the present invention will be described with reference to FIG. 1.

Figure 1:
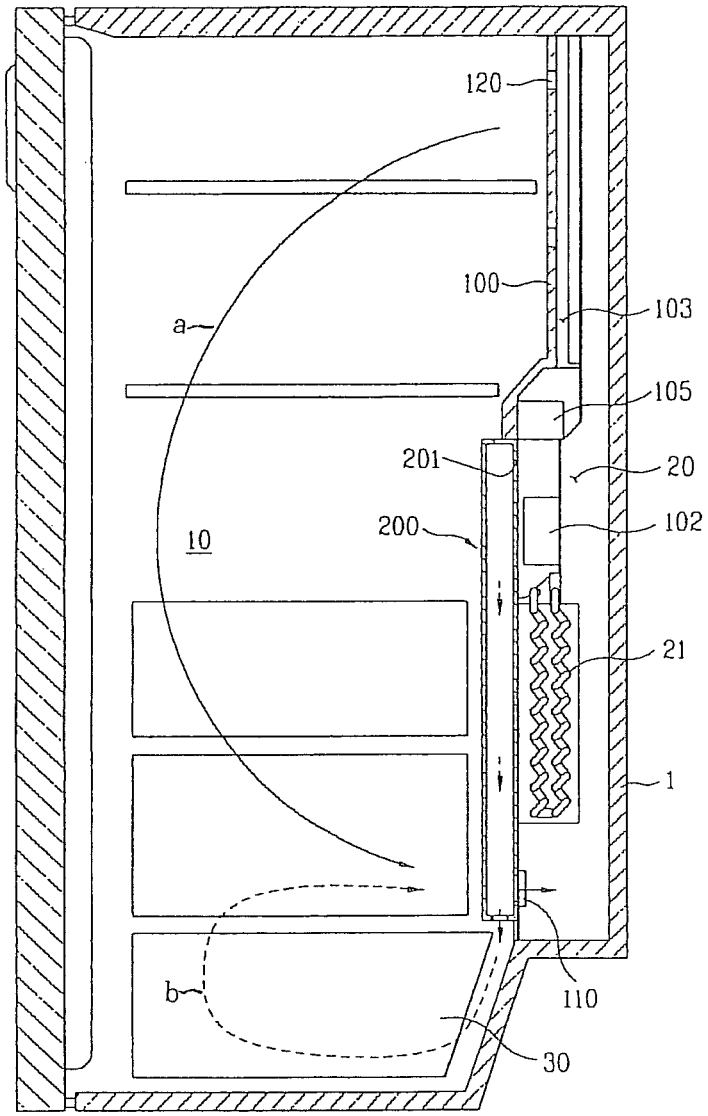
FIG. 1 is a side sectional view illustrating a refrigerator according to a first embodiment of the present invention.

As shown in FIG. 1, the refrigerator according to the first embodiment of the present invention includes a refrigerator body 1, a cold chamber 10 disposed in the refrigerator body 1, a cool air generation chamber 20 for supplying cool air to the cold chamber 10, and a partition plate 100 for partitioning the cold chamber 10 and the cool air generation chamber 20 from each other.

In the cold chamber 10 are disposed storage chambers 30 where cooling is independently carried out. The storage chambers 30 are provided to rapidly cool objects to be cooled, stored therein, or store the objects at regular temperatures for a long time.

In the cool air generation chamber 20 is disposed a cooler 21 for generating cool air. The cooler 21 may be materialized by an evaporator connected to specific devices constituting a refrigeration cycle. Alternatively, the cooler 21 may be materialized by a thermoelectric device.

The partition plate 100 partitions the cold chamber 10 and the cool air generation chamber 20 from each other. The partition plate 100 is provided with a cool air flow channel through which cool air generated by the cooler 21 is supplied to the cold chamber 10 and the storage chambers 30. A fan 102 is mounted in the cool air flow channel of the partition plate 100.

The cool air generated by the cooler 21 is moved by the fan 102, and is then supplied to the cold chamber 10 or the storage chambers 30 through a flow channel communicating with the cold chamber 10 and/or a flow channel communicating with the storage chambers 30.

Here, the flow channel communicating with the cold chamber 10 is defined by a main flow channel 103, and the flow channel communicating with the storage chambers 30 is defined by a bypass duct 200.

The main flow channel 103 is opened or closed by a damper 105 for controlling the flow of cool air to be supplied to the cold chamber 10.

The partition plate 100 has discharge ports 120 through which cool air is discharged to the cold chamber 10 and suction ports 110 through which the cool air discharged to the cold chamber 10 is suctioned to the cool air generation chamber 20.

Also, the partition plate 100 has a cool air hole 201 communicating with the bypass duct 200 for allowing cool air to flow along the bypass duct 200 therethrough.

In this case, cool air supplied through the bypass duct 200 directly cools containers constituting the storage chambers 30, whereby objects to be cooled, in the storage chambers 30, are indirectly cooled.

Figure 2:
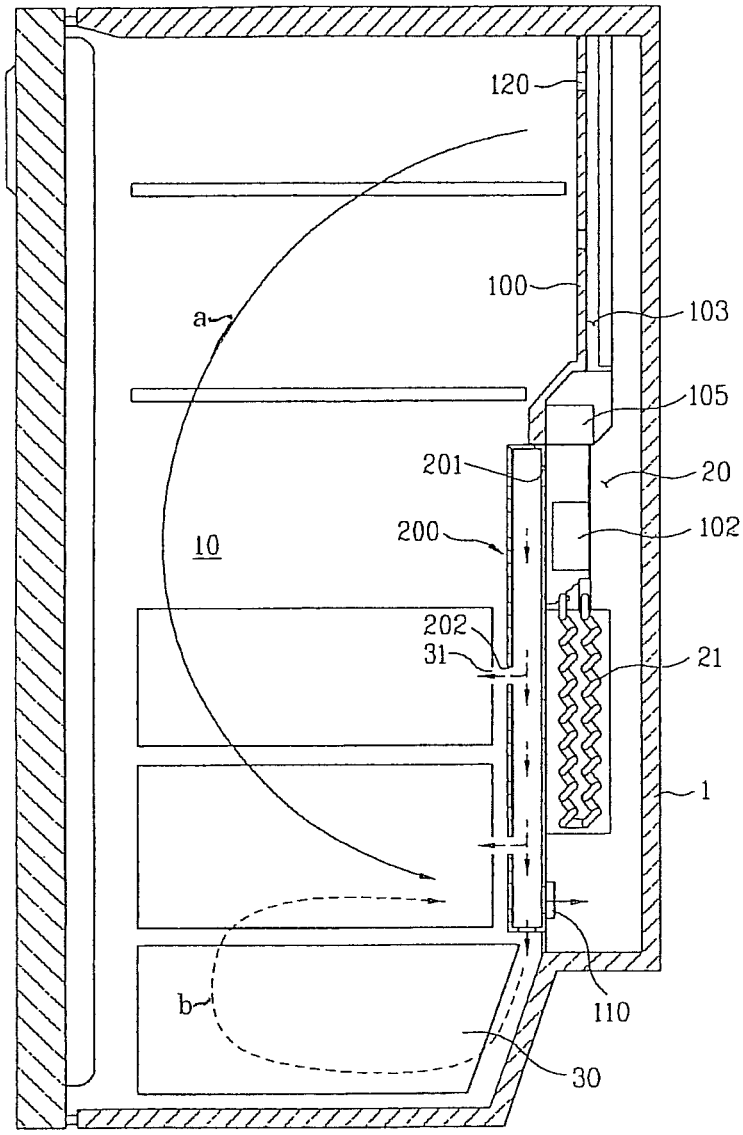
FIG. 2 is a side sectional view illustrating a refrigerator according to a second embodiment of the present invention.

FIG. 2 illustrates a refrigerator according to a second embodiment of the present invention. This embodiment is characterized in that the storage chambers 30 are spaced apart from the corresponding end of the bypass duct 200, and a communication port 31 of a predetermined size is formed at each storage chamber 30 such that cool air supplied through the bypass duct 200 is introduced into the respective storage chamber 30 through the communication port 31.

The bypass duct 200 has predetermined guide holes 202 such that cool air discharged through the guide holes 202 is directly introduced into the respective storage chamber 30 through the communication ports 31.

In this case, the positions of the guide holes 202 preferably correspond to the positions of the communication ports 31.

Figure 3:
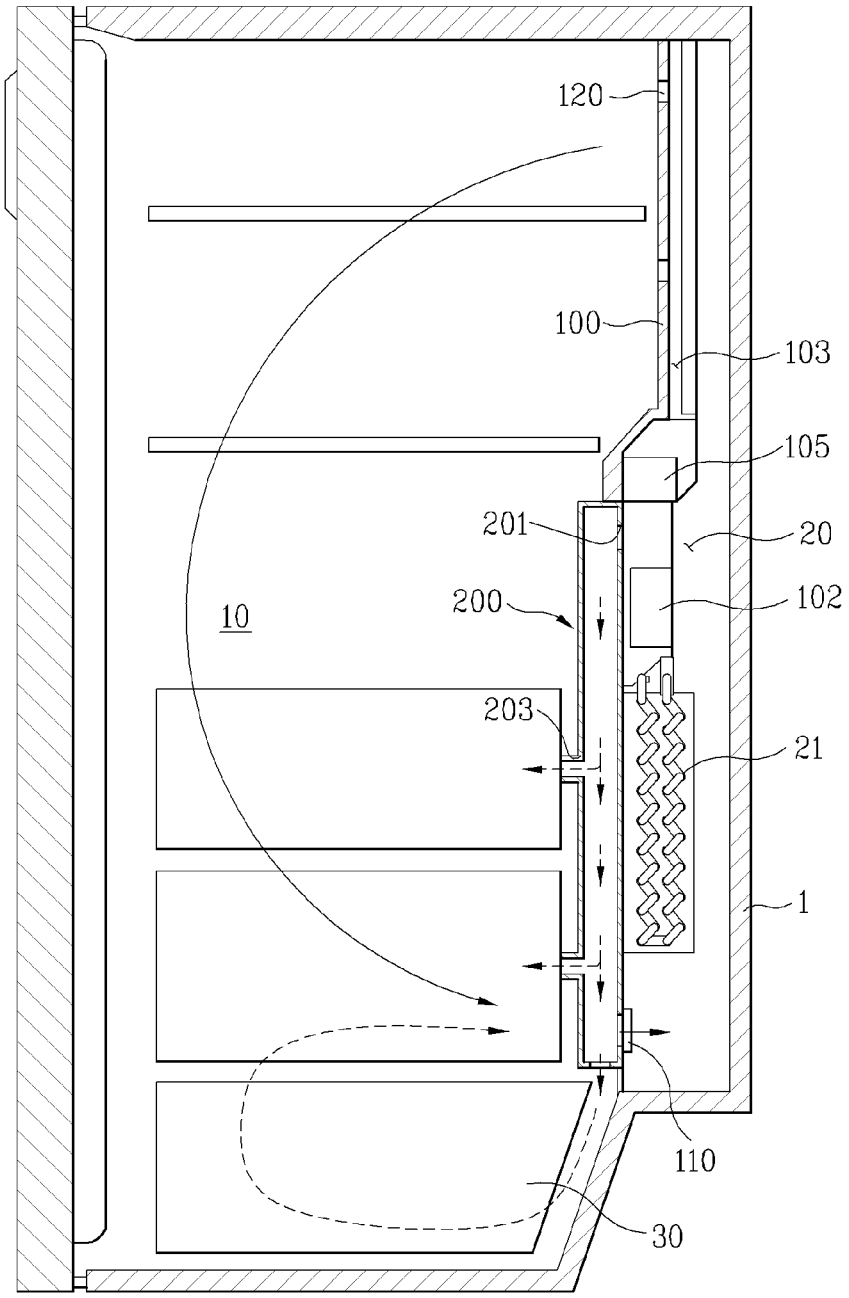
FIG. 3 is a side sectional view illustrating a refrigerator according to a third embodiment of the present invention.

FIG. 3 illustrates a refrigerator according to a third embodiment of the present invention. This embodiment is characterized in that the storage chambers 30 are directly connected to the bypass duct 200 through connection channels 203, through which cool air, flowing along the bypass duct 200, is directly introduced into the respective storage chambers 30.

Hereinafter, principal components of the refrigerator according to the present invention will be described in more detail with reference to FIG. 4.

Figure 4:
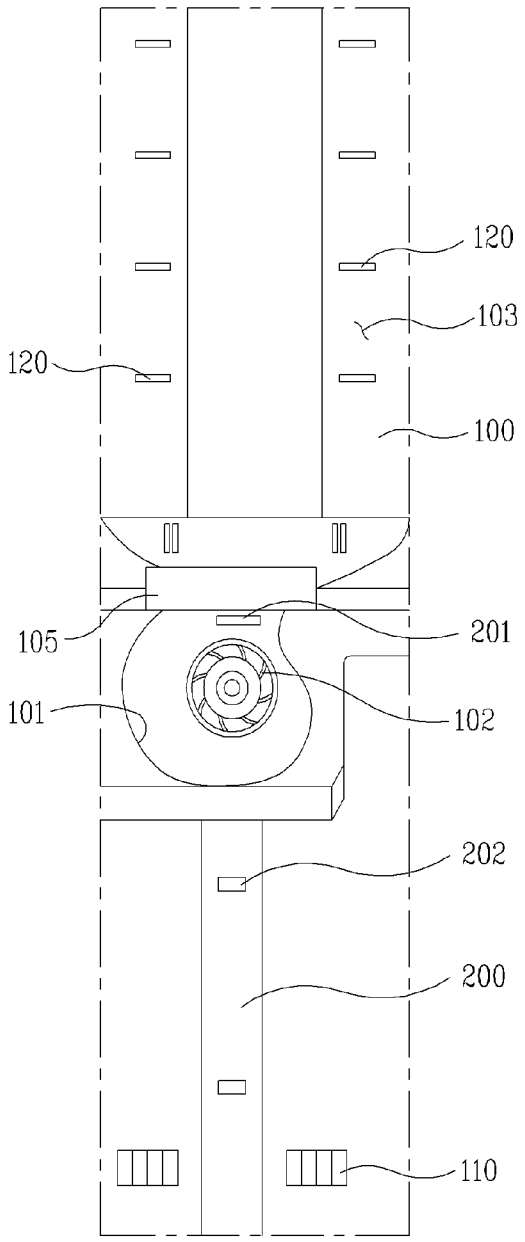
FIG. 4 is a view illustrating principal components of the refrigerator according to the present invention.

As shown in FIG. 4, the fan 102 is mounted at one side of the partition plate 100. The fan is preferably a cross-flow fan.

That is, the fan 102 suctions cool air in the axial direction, and blows the suctioned cool air in the radial direction.

At this time, the cool air, moved by the fan 102, is guided by a guide part 101 and is then supplied to the main flow channel 103 and the bypass duct 200.

The guide part 101 is formed in the shape of a recess having a predetermined thickness. The edge of the guide part 101 is curved with a predetermined curvature.

That is, as shown in FIG. 4, one side of the guide part 101 is curved to be adjacent to the fan 102, and the guide part 101 extends in a curved shape from the portion of the guide part 101 where the guide part 101 is adjacent to the fan 102, while the guide part 101 is spaced a predetermined distance from the fan 102, such that the guide part 101 is connected to the main flow channel 103.

Between the guide part 101 and the main flow channel 103 is mounted a damper 105 for controlling the flow of cool air from the guide part 101 to the main flow channel 103.

That is, the damper 105 serves to open or close the main flow channel 103. The damper 105 may be operated in a sliding fashion or a rotating fashion.

Meanwhile, the cool air hole 201 is located between the damper 105 and the fan 102. The cool air hole 201 communicates with the bypass duct 200.

Consequently, when cool air is to be supplied to the storage chambers 30, the damper 105 is operated to close the main flow channel 103, and the fan 102 is operated to supply the cool air to the storage chambers 30 along the bypass duct 200 through the cool air hole 201.

On the other hand, when cool air is to be supplied to the cold chamber 10, the damper 105 is operated to open the main flow channel 103, and the fan 102 is operated to supply the cool air to the main flow channel 103. The cool air supplied to the main flow channel 103 is supplied to the cold chamber 10 through the discharge ports 120.

Since the cool air hole 201 is located between the damper 105 and the fan 102, i.e., cool air, blown from the fan 102, passes by the cool air hole 201 before the cool air is introduced into the main flow channel 103.

While the cool air, blown from the fan 102, passes by the cool air hole 201, some of the cool air is bypassed through the cool air hole 201 and is supplied to the storage chambers 30 through the bypass duct 200. Most of the cool air is introduced into the main flow channel 103 and is then supplied to the cold chamber 10.

If the size of the cool air hole 201 is large, the amount of the cool air introduced into the main flow channel 103 decreases. Consequently, it is preferred to form the cool air hole 201 in the shape of a slot extending horizontally.

That is, the cool air hole 201 is formed in the shape of a slot formed in a structure in which the length of the slot is small in the direction in which the cool air advances, and the length of the slot is large in the direction perpendicular to the direction in which the cool air advances. Consequently, even when the cold chamber 10 is operated, some of the cool air is bypassed to the storage chambers 30.

Meanwhile, when the guide holes 202 of the second embodiment are formed at the bypass duct 200, it is preferred for the guide holes 202 be arranged on the front of the bypass duct 202 while the guide holes 202 are spaced a predetermined distance from each other.

Also, the connection channels 203 of the third embodiment may be located at positions corresponding to the guide holes 202.

Hereinafter, the operation of the refrigerator according to the present invention will be described with reference to FIGS. 1 to 4.

First, the operation of the cold chamber 10 will be described.

When the cooler 21 is operated to generate cool air, and the fan 102 is operated to suction cool air around the cooler 21 and blow the suctioned cool air in the radial direction.

The blown cool air is guided by the guide part 101, flows along the main flow channel 103, and is then supplied to the cold chamber 10 through the discharge ports 120.

At this time, some of the cool air, blown by the fan 102, is bypassed to the cool air hole 201 and is then supplied to the storage chambers 30 along the bypass duct 200.

Consequently, the cold chamber 10 is cooled, and, at the same time, some of the cool air is supplied to the storage chamber 30 such that the storage chambers 30 can be maintained at predetermined temperatures.

Also, as shown in FIG. 1, the cool air discharged through the respective discharge ports 120 flows along a route a, and is then introduced into the suction ports 110. The cool air discharged through the bypass duct 200 flows along a route b, and is then introduced into the suction ports 110.

The cool air discharged through the discharge ports 120 may halt at the lower part of the cold chamber 10. In the refrigerator according to the present invention, the cool air discharged through the bypass duct 200 flows along the route b as shown in FIG. 1. Consequently, it is possible to achieve smooth circulation of cool air without halt, and therefore, it is possible to prevent the increase in temperature deviation of the cold chamber 10.

Meanwhile, when objects needed to be rapidly cooled are to be stored in the storage chambers 30, it is required to intensively supply cool air to the storage chambers 30. Consequently, the damper 105 is operated to close the main flow channel 103, and the fan 102 is operated to blow cool air such that the cool air is introduced into the bypass duct 200 through the cool air hole 201.

The cool air introduced into the bypass duct 200 is supplied to the storage chambers 30 along the bypass duct 200, flows along the route b shown in FIG. 1, and is then introduced into the suction ports 110, whereby the circulation of the cool air is achieved.

On the other hand, when the guide holes 202 are formed at the bypass duct 200 and the communication ports 31 are formed at the storage chambers 30, as shown in FIG. 2, some of the cool air flowing along the bypass duct 200 may be introduced into the communication ports 31 through the corresponding guide holes 202.

When the connection channels 203 are disposed between the storage chambers 30 and the bypass duct 200, as shown in FIG. 3, some of the cool air in the bypass duct 200 flows downward along the bypass duct 200, and reaches the lower part of the cold chamber 10.

Also, some of the cool air moves to the storage chambers 30 along the connection channels 203.

Hereinafter, a refrigerator according to a fourth embodiment of the present invention will be described with reference to FIG. 5.

Figure 5:
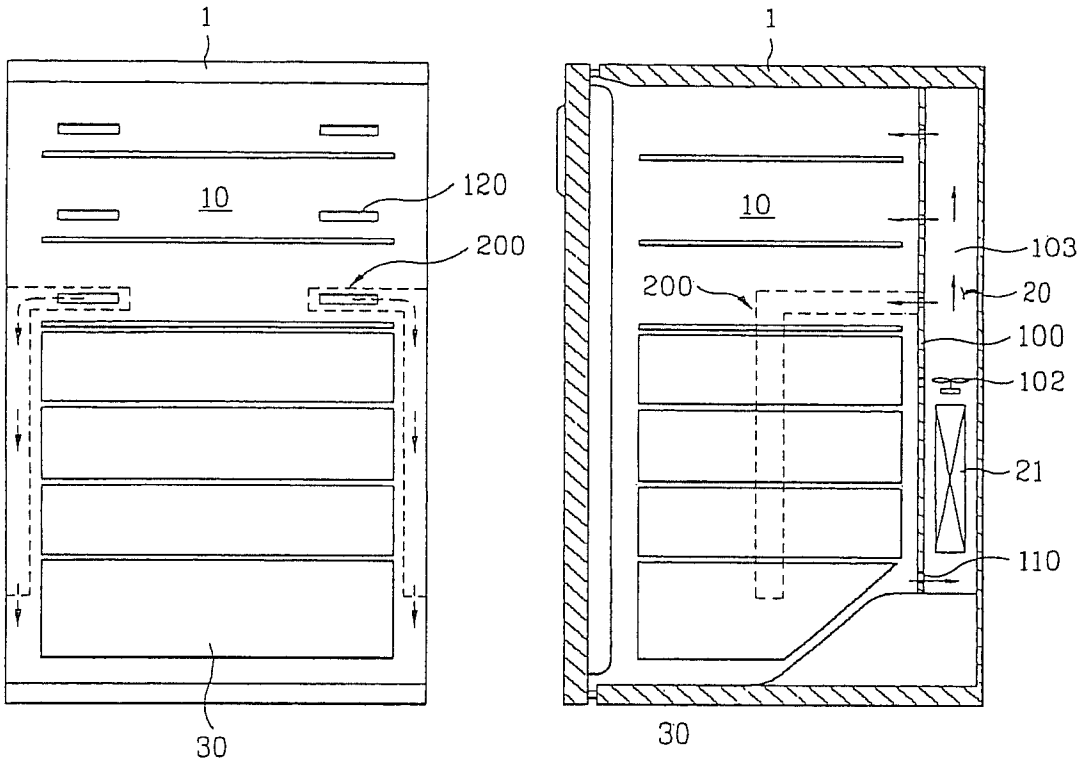
FIG. 5 is a view illustrating a refrigerator according to a fourth embodiment of the present invention.

As shown in FIG. 5, the refrigerator according to the fourth embodiment of the present invention includes a refrigerator body 1, a cold chamber 10 disposed in the refrigerator body 1, a cool air generation chamber 20 for supplying cool air to the cold chamber 10, and a partition plate 100 for partitioning the cold chamber 10 and the cool air generation chamber 20 from each other.

In the cold chamber 10 are disposed storage chambers 30 where cooling is independently carried out. The storage chambers 30 according to the fourth embodiment of the present invention are substantially identical in construction and operation to those according to the first embodiment of the present invention shown in FIG. 1.

Also, the cooler 21 disposed in the cool air generation chamber 20 is substantially identical in construction and operation to that according to the first embodiment of the present invention shown in FIGS. 1 and 4, and therefore, a detailed description thereof will not be given.

The partition plate 100 partitions the cold chamber 10 and the cool air generation chamber 20 from each other. The partition plate 100 is provided with a cool air flow channel through which cool air generated by the cooler 21 is supplied to the cold chamber 10 and the storage chambers 30. A fan 102 is mounted in the cool air flow channel of the partition plate 100.

The cool air generated by the cooler 21 is moved by the fan 102, and is then supplied to the cold chamber 10 or the storage chambers 30 through a flow channel communicating with the cold chamber 10 and/or flow channels communicating with the storage chambers 30.

Here, the flow channel communicating with the cold chamber 10 is defined by a main flow channel 103, and the flow channels communicating with the storage chambers 30 are defined by bypass ducts 200.

The bypass ducts 200 are constructed to communicate with one or more of discharge ports 120 formed at the partition plate 100.

Specifically, cool air, blown by the fan 102, is supplied to the cold chamber 10 through the discharge ports 120. At this time, the cool air is supplied to the storage chambers 30 along the bypass ducts 200, since some of the discharge ports 120 communicate with the bypass ducts 200.

Although not shown in FIG. 5, opening and closing member (not shown) may be mounted in the discharge ports 120 communicating with the bypass duct 200 for opening and closing the corresponding discharge ports 120 to selectively supply the cool air to the storage chambers 30.

The bypass ducts 200 are preferably disposed at sides of the cold chamber 10 in consideration of the capacity of the cold chamber 10.

FIG. 5 illustrates the bypass ducts 200 disposed at opposite sides of the cold chamber 10, although a bypass duct 200 may be disposed at one side of the cold chamber 10.

The cool air discharged through the discharge ports 120, i.e., both of the cool air supplied to the cold chamber 10 and the cool air supplied to the storage chambers 30 are introduced into the cool air generation chamber 20 through the suction ports 110, whereby the circulation of the cool air is achieved.

The ends of the bypass ducts 200 may be connected to the storage chambers 30 such that the cool air supplied through the bypass ducts 200 can be directly introduced into the storage chambers 30. Alternatively, the bypass ducts 200 and the storage chambers 30 may be spaced a predetermined distance from each other, and communication holes (not shown) of a predetermined size may be formed at the storage chambers 30 such that the cool air discharged through the bypass duct 200 can be supplied to the storage chambers 30 through the communication holes (not shown).

Also, containers constituting the storage chambers 30 may be cooled by the cool air supplied through the bypass ducts 200 such that objects to be cooled, in the storage chambers 30, are indirectly cooled.

Hereinafter, a refrigerator according to a fifth embodiment of the present invention will be described with reference to FIG. 6.

Figure 6:
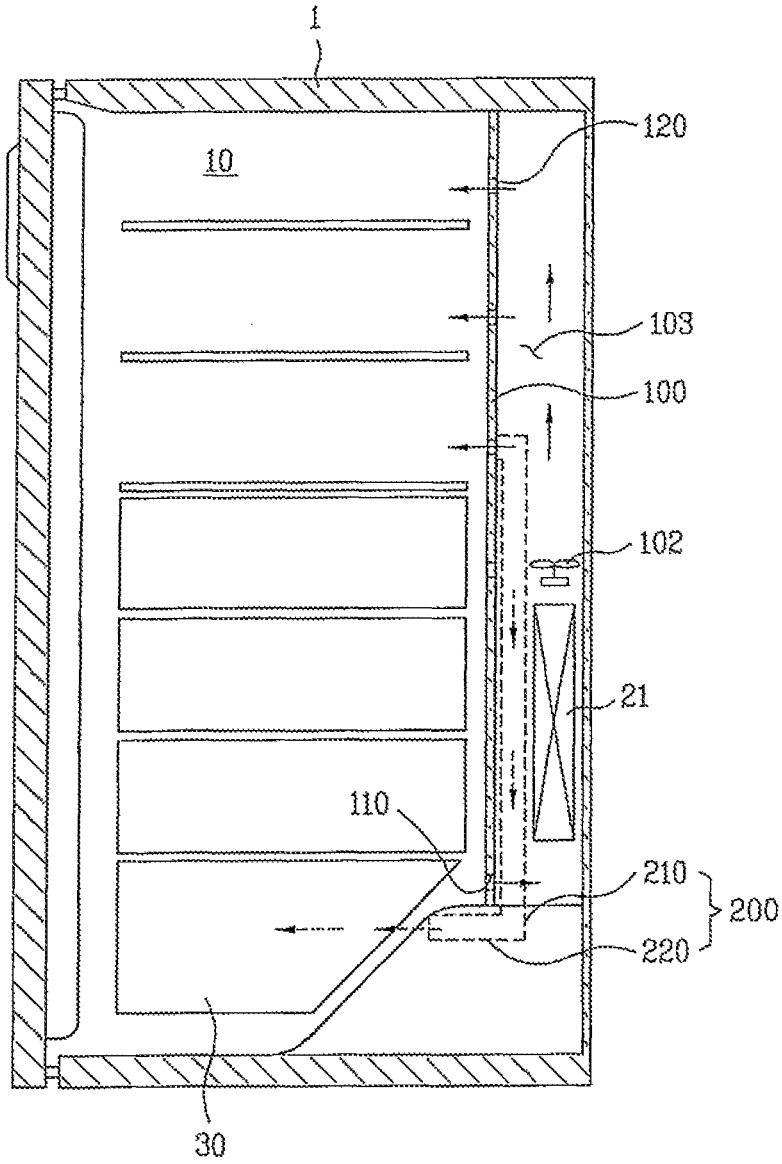
FIG. 6 is a view illustrating a refrigerator according to a fifth embodiment of the present invention.

As shown in FIG. 6, the refrigerator includes a refrigerator body 1, a cold chamber 10 disposed in the refrigerator body 1, a cool air generation chamber 20 for supplying cool air to the cold chamber 10, and a partition plate 100 for partitioning the cold chamber 10 and the cool air generation chamber 20 from each other.

In the cold chamber 10 are disposed storage chambers 30 where cooling is independently carried out. The storage chambers 30 according to the fifth embodiment of the present invention are substantially identical in construction and operation to those according to the first embodiment of the present invention shown in FIGS. 1 and 4.

Also, the cooler 21 disposed in the cool air generation chamber 20 is substantially identical in construction and operation to that according to the previous embodiments of the present invention shown in FIGS. 1 and 4, and therefore, a detailed description thereof will not be given.

The partition plate 100 partitions the cold chamber 10 and the cool air generation chamber 20 from each other. The partition plate 100 is provided with a cool air flow channel through which cool air generated by the cooler 21 is supplied to the cold chamber 10 and the storage chambers 30. A fan 102 is mounted in the cool air flow channel of the partition plate 100.

The cool air generated by the cooler 21 is moved by the fan 102, and is then supplied to the cold chamber 10 or the storage chambers 30 through a flow channel communicating with the cold chamber 10 and/or a flow channel communicating with the storage chambers 30.

Here, the flow channel communicating with the cold chamber 10 is defined by a main flow channel 103, and the flow channel communicating with the storage chambers 30 is defined by a bypass duct 200.

The bypass ducts 200 includes a first duct part 210 communicating with the cool air generation chamber 20, the first duct part 210 extending vertically, and a second duct part 220 integrally formed with or coupled to the first duct part 210, the second duct part 220 extending toward the storage chambers 30.

The first duct part 210 is mounted in the cool air generation chamber 20 such that the first duct part 210 is disposed between the partition plate 100 and the cooler 21.

Preferably, the first duct part 210 extends in the shape of a straight line such that the first duct part 210 is directed downward, and the second duct part 220 extends from the lower end of the first duct part 210 such that second duct part 220 is directed toward the lower part of the cold chamber 10 and the storage chambers 30 in the front direction.

Consequently, when cool air is blown by the fan 102, some of the cool air introduced into the main flow channel 103 is bypassed to the first duct part 210, and is then supplied to the storage chambers 30 through the second duct part 220.

At the end of the first duct part 210 may be mounted an opening and closing valve (not shown) for selectively supply cool air to the storage chambers 30.

The invention claimed is:

1. A refrigerator, comprising:

a refrigerator body having a cold chamber defined therein, and one or more storage chambers disposed in a lower portion of the cold chamber, wherein the one or more storage chambers is in the form of one or more containers, a lowermost one of the one or more storage chambers being disposed adjacent a lower wall of the cold chamber;

a cool air generation chamber having a cooler and a fan that supplies cool air mounted therein;

a partition plate that partitions the cold chamber and the cool air generation chamber from each other, the partition plate having a main flow channel that guides the cool air supplied by the fan to the cold chamber and at least one cool air hole located between the fan and the main flow channel, through which the cool air is directed to the one or more storage chambers;

at least one bypass duct that guides the cool air bypassed through the at least one cool air hole to the one or more storage chambers; and a damper mounted in the cool air generation chamber such that the damper is disposed between the bypass duct and the main flow channel, that selectively opens and closes the main flow channel, wherein the one or more storage chambers is cooled more rapidly by the cool air supplied through the at least one bypass duct when the damper is closed than when the damper is opened, wherein the at least one cool air hole is disposed over the cooler and the lowermost one of the one or more storage chambers is disposed under the cooler, and wherein the at least one bypass duct extends from the at least one cool air hole to the lowermost one of the one or more storage chambers in a vertical direction.

2. The refrigerator according to claim 1, wherein the at least one cool air hole is formed in a shape of a slot lengthened in a direction perpendicular to a direction in which the cool air flows from the fan to the main flow channel.

3. The refrigerator according to claim 1, wherein the at least one bypass duct is disposed at a front surface of the partition plate.

4. The refrigerator according to claim 1, wherein the at least one bypass duct extends from the at least one cool air hole to the lowermost one of the one or more storage chambers along at least one side of the cold chamber.

5. The refrigerator according to claim 1, wherein a central longitudinal axis of the at least one bypass duct extends parallel to a central longitudinal axis of the refrigerator body.

6. A refrigerator, comprising:

a refrigerator body;

a cold chamber defined in the refrigerator body;

one or more storage chambers disposed in a lower portion of the cold chamber, wherein the one or more storage chambers is in the form of one or more containers, a lowermost one of the one or more storage chambers being disposed adjacent a lower wall of the cold chamber;

a main flow channel that communicates with the cold chamber and guides cool air to the cold chamber;

at least one bypass duct disposed separately from the main flow channel that guides the cool air in a direction in which the cool air flows to the one or more storage chambers and in a direction different from a flow direction of the cool air guided by the main flow channel, to cool down an interior temperature of the cold chamber uniformly;

a cooler that generates cool air;

a cool air generation chamber that communicates with the at least one bypass duct and the main flow channel, wherein the cooler and a fan are mounted in the cool air generation chamber; and a damper mounted in the cool air generation chamber between the at least one bypass duct and the main flow channel, that selectively opens and closes the main flow channel, wherein the one or more storage chambers is cooled more rapidly by the cool air supplied through the at least one bypass duct when the damper is closed than when the damper is opened, wherein the at least one cool air hole is disposed over the cooler and the lowermost one of the one or more storage chambers is disposed under the cooler, and wherein the at least one bypass duct extends from the at least one cool air hole to the lowermost one of the one or more storage chambers in a vertical direction.

7. The refrigerator according to claim 6, wherein the at least one bypass duct is disposed at a rear surface of the one or more storage chambers.

8. The refrigerator according to claim 6, wherein the at least one bypass duct is disposed along at least one side of the cold chamber.

9. The refrigerator according to claim 6, wherein the at least one bypass duct is disposed such that the at least one bypass duct communicates with the main flow channel, and wherein some of the cool air flowing along the main flow channel flows to the at least one bypass duct.

10. The refrigerator according to claim 6, further comprising:

a communication port formed at the one or more storage chambers that guides an introduction of the cool air in the cold chamber to the one or more storage chambers.

11. The refrigerator according to claim 10, further comprising:

a guide hole formed at the at least one bypass duct at a position corresponding to the communication port of the one or more storage chambers that guides the cool air to the communication port.

12. The refrigerator according to claim 6, further comprising:

a connection channel that directly interconnects the at least one bypass duct and the one or more storage chambers and guides the cool air.

13. A refrigerator, comprising:

a refrigerator body having a cold chamber defined therein, and one or more storage chambers disposed in a lower portion of the cold chamber, wherein the one or more storage chambers is in the form of one or more containers, a lowermost one of the one or more storage chambers being disposed adjacent a lower wall of the cold chamber;

a cool air generation chamber having a cooler and a fan that supplies cool air mounted therein;

a partition plate that partitions the cold chamber and the cool air generation chamber from each other, the partition plate having a main flow channel that guides the cool air supplied by the fan to the cold chamber; and at least one bypass duct that includes:

a first duct disposed in the cool air generation chamber that guides the cool air in a downward direction; and a second duct that is connected to the first duct and extends from the first duct toward the one or more storage chambers, wherein the second duct guides the cool air from the first duct to the lowermost one of one or more storage chambers; and a damper mounted in the cool air generation chamber such that the damper is disposed between the bypass duct and the main flow channel, that selectively opens and closes the main flow channel, wherein the one or more storage chambers is cooled more rapidly by the cool air supplied through the at least one bypass duct when the damper is closed than when the damper is opened, wherein the at least one cool air hole is disposed over the cooler and the lowermost one of the one or more storage chambers is disposed under the cooler, and wherein the at least one bypass duct extends from the at least one cool air hole to the lowermost one of the one or more storage chambers in a vertical direction.

14. The refrigerator according to claim 13, wherein the first duct is disposed in the cool air generation chamber such that the first duct extends in the downward direction to a region proximal to the lowermost one of the one or more storage chambers, and wherein the second duct extends from a lower end of the first duct toward the lowermost one of the one or more storage chambers.

15. The refrigerator according to claim 13, wherein the first duct is disposed between the partition plate and the cooler.

* * * * *